US007962087B2

(12) United States Patent
Spence

(10) Patent No.: US 7,962,087 B2
(45) Date of Patent: Jun. 14, 2011

(54) RADIUS PROFILED VACUUM MEDIA HANDLING TRANSPORT

(75) Inventor: James J. Spence, Honeoye Falls, NY (US)

(73) Assignee: Xerox Corporation, Norwalk, CT (US)

( * ) Notice: Subject to any disclaimer, the term of this patent is extended or adjusted under 35 U.S.C. 154(b) by 1019 days.

(21) Appl. No.: 11/771,147

(22) Filed: Jun. 29, 2007

(65) Prior Publication Data

US 2009/0003909 A1 Jan. 1, 2009

(51) Int. Cl.
*G03G 15/00* (2006.01)

(52) U.S. Cl. ..... 399/400; 399/305; 399/307; 399/318; 399/320; 399/322; 399/328; 399/341; 271/283

(58) Field of Classification Search ..... 399/305, 399/318, 320, 328, 341, 307, 322, 400; 271/283
See application file for complete search history.

(56) References Cited

U.S. PATENT DOCUMENTS 5,296,904 A * 3/1994 Jackson ..... 399/328
5,548,388 A * 8/1996 Schieck ..... 399/381
5,991,575 A * 11/1999 Okiyama et al. ..... 399/165
6,873,821 B2 * 3/2005 Russel et al. ..... 399/400
2005/0220505 A1 * 10/2005 Hashimoto et al. ..... 399/322
2006/0245795 A1 * 11/2006 Kamiyama ..... 399/322

* cited by examiner

*Primary Examiner* — Daniel J Colilla
*Assistant Examiner* — Andy L Pham
(74) *Attorney, Agent, or Firm* — Oliff & Berridge, PLC

(57) ABSTRACT

System and methods providing a plurality of fusers, and one or more radius profiled media handling transports for transporting media in a radius, in an image forming device. The system includes one or more of a plurality of fusers, and radius profiled media handling transport devices arranged in a fashion allowing for improved throughput of media while reducing operating costs. The plurality of fusers allows for the use of individual low capacity fusers that are equal to or less than the overall capacity of the image forming device. Media transport devices transport media on stretch belts across a radius of rollers with a means for providing an adhering force for stabilizing the media to the belt. The rollers are arranged along one side of the frame, along which the media is transported, and a frame may contain an air plenum so as to allow for the drawing of a vacuum through the rollers. The media transport device allows for optimizing a configuration of the image forming device.

30 Claims, 7 Drawing Sheets

RADIUS PROFILED VACUUM MEDIA HANDLING TRANSPORT

BACKGROUND

This disclosure is directed to systems and methods that provide improvements in substrate handling in image forming devices.

Printers, copiers and other types of image forming devices have become necessary productivity tools for producing and/or reproducing documents. Such image forming devices include, but are not limited to, desktop copiers, stand-alone copiers, scanners, facsimile machines, photographic copiers and developers, multi-function devices and other like systems capable of producing and/or reproducing image data from an original document, data file or the like.

As the technology expands, configurations of image forming devices are becoming increasingly more capable, and coincidentally increasingly more complex. An objective remains of allowing for greater image productivity and/or throughput while maintaining image quality. Conventionally, various types of image forming devices transport output image receiving media in linear or straight line paths, particularly between marking modules and fusing modules, in order that image forming substances deposited, for example, on output image receiving media are not disturbed prior to being ultimately fixed on the output image receiving media. Such capabilities depend on the systems themselves, for example, in the modes of operation of the systems and/or the physical complexity of the systems.

To maximize productivity in image forming devices, each component of the image forming device should be sized and/or configured in such a manner to optimize throughput of the particular component in order to attempt to maximize overall throughput capacity of the image forming device. System and device design then strikes a balance between increasing the throughput capacity of the image forming device with, for example, mediating increases in overall costs associated with the image forming device including not only increased device production costs but also increased operating costs due to, for example, increased energy costs associated with an increased throughput for which design of the device should be optimized.

Each component internal to, or associated with, image production, in an image forming device should be optimally sized for an expected maximum throughput for the overall system. Limitations in an available throughput of individual output image receiving medium substrates, upon which images are to be formed, can be analyzed with respect to each individual component. Certain of the components in the image forming device, by their characteristic nature, may tend to impede the image forming process to a greater degree than others. It is these individual components upon which a system designer may focus in attempting to optimize an output image receiving medium throughput in an image forming device.

There are many areas regarding output image receiving media substrate handling that lend themselves to optimization within image forming devices as currently configured and operated. Two examples for optimization are addressed by the systems and methods according to this disclosure as will be discussed in more detail below. Regarding image formation in, for example, electrostatic and/or xerographic image forming devices. The first component which may lend itself to optimization is the fixing and/or fusing system and individual fusers. Commonly employed to fix and/or fuse image forming substances on output image receiving media, often by a combination of heat and pressure, these modules may represent a limiting factor regarding both output image receiving media substrate throughput for, and total energy costs for operation of, a specific image forming device within which the fusing module is housed, or with which the fusing module is associated. Limitation in image output imaging receiving media throughput may arise from operating, at a controlled rate, the single fuser of a specific image forming device. Not only do fusing modules potentially limit a throughput of output image receiving media substrates, but an individual fusing module may also significantly affect specific energy costs. As such, fusing modules tend to highlight the balance required in maximizing throughput of an image forming device with other considerations with regard to specific employment. During periods of high throughput, an individual fuser may tend to generate significant heat in operation resulting in, for example, an overheat condition. Such condition may cause, for example, a thermally-based slow down and/or shutdown in the image forming device in order to preserve output image quality, and/or to prevent damage due to heat in one or more components of the image forming device. It should be recognized coincidentally that a high throughput fusing module may expend virtually the same energy regardless of an actual throughput of output image receiving media being experienced. In other words, during periods of low throughput operations, a need to maintain a high throughput fusing module heated to the same level as may be acquired for high throughput operation results in higher fusing module operating costs. These costs represents a significant portion of the energy operating costs for the image forming device, which are not optimized.

A second area to be optimized concerns configurations for output image receiving media substrate handling paths within an image forming device. Certain considerations, particularly those incumbent in transporting individual substrates upon which image forming substances have been deposited in, for example, a marking module to a fusing module in a manner that does not disturb the image forming substance deposited on the substrate prior to such substance being fixed on the substrate are considerations that tend to limit design of the substrate handling paths, particularly between marking modules and fusing modules in the image forming device. As such, physical complexity in the image forming device may also affect an available throughput. Conventionally, output image receiving media exiting the marking module, where, for example, electrostatically charged toner particles are deposited on an electrostatically charged substrate, must be very carefully handled because unfused toner is susceptible to distortion if subjected to any physical disturbance as may be induced by, for example, handling the output image receiving media in a non-linear manner.

Unfused media is a term used to describe output image receiving media to which an image forming substance such as, for example, toner has been applied in the formation of a copy of an original image, that includes text and/or graphics, and upon which the toner has not yet been fixed, generally by some form of heat and/or pressure fusing. Unfused media is particularly susceptible to image degradation based on forces due to compression and tension when such media is bent as the unfused media is being transported in a non-linear manner. Degradation of an unfused toner image, which forms the copy of the text and/or graphics, results based on disturbing the formation of the unfused toner on the unfused media. For this reason, conventionally, once the unfused media exits the marking module, the unfused media is handled in a linear manner throughout transport to a finisher such as, for example, a fusing module. Linear handling along even a portion of the image receiving media handling path in an image forming device restricts variation or optimization in an overall configuration for image forming device.

SUMMARY

As indicated above, a drawback with conventional systems and methods associated with image forming devices may include requirements to size a single fuser to maximize a throughput of the image forming device. The fusing module operates at one continuous energy setting so that repeated start-up and warm-up times are not required between relatively low throughput operations and high throughput operations. Additionally, by using a single fuser, the productivity of the image forming device is limited to that of the single fuser subject to thermal overload conditions during periods of high throughput, or other fusing module specific limitations.

Another drawback with conventional systems and methods associated with image forming devices is the requirement to handle large volumes of unfused media, after application of a toner, in a linear, generally horizontal, manner in order not to disrupt the formation of the text and/or graphics copy, created by the toner on the unfused media, prior to fixedly attaching the toner to the media by fusing or other means. In other words, prior to fusing the toner to the media, the unfused media must be handled in a manner that does not disturb the toner so as to corrupt the image formed on the media. An overall size of a image forming device cannot, for example, be easily further reduced due to the need for linear transport of the media prior to fusing.

It would be advantageous, in view of the above-identified shortfalls, to provide a system, within or related to one or more image forming devices, that would allow increased productivity by providing systems and/or image forming devices with systems, or individual image forming devices with increased throughput capacity and increased configuration flexibility, while coincidentally reducing overall operating costs.

Disclosed systems and methods may address the above-identified shortfalls by providing an image forming device with a plurality of fusers in one or more fusing modules, in which each fuser may operate at an optimized overall throughput based on need, thereby potentially increases overall throughput while optimizing operating costs for such systems and devices. A plurality of fusers may be individually sized so that the total throughput capacity of the plurality of fusers would not be a limiting factor with regard to a total throughput capacity of the image forming device.

Disclosed systems and methods may further address the above-identified shortfalls by providing image receiving media handling systems in image forming devices allowing for transport of particularly unfused media in a limiting non-linear manner such that a direction of transport of the unfused media between, for example, a marking module and a fusing module can be changed after application of an image forming substance and prior to fixing or fusing the image forming substance on the output image receiving medium.

Disclosed systems and methods may provide a capability within a system or image forming device to deviate the path of the unfused media in a non-linear manner to transport unfused media along a plurality of paths to a plurality of fusers or fusing modules such that multiple fusers or fusing modules could simultaneously fuse image forming substances to multiple output image receiving media substrates, therefore optimizing the efficiency and potentially size of the overall image forming device while maximizing potential throughput.

In exemplary embodiments, the systems and methods according to this disclosure may provide, in an image forming device, a plurality of fusers in one or more fusing modules disposed between an output side of a marking module and an input side of an output module. A throughput capacity of the sum of all of the plurality of fusers may be at least equal to, and preferably greater than, a maximum throughput capacity of every other component system within the image forming device.

In various exemplary embodiments, the systems and methods according to this disclosure may provide a marking module in an image forming device that may include a capability by which individual unfused media exiting the marking module with unfused toner deposited thereon may be directed by, for example, a diverter gate that allows for automatic diversion/transport of the unfused media to one or more of a selected plurality of fusers. The diverter gate may allow for a plurality of transport paths from the marking module to the plurality of fusers.

In various exemplary embodiments, the systems and methods according to this disclosure may provide, in an image forming device, a marking module with a plurality of selectable output paths allowing for the transport of unfused media to one of a plurality of fusers. One or more of these output paths, from the marking module, may advantageously include at least one radius profiled media handling transport system.

An exemplary radius profiled media handling system according to this disclosure may comprise, for example, a frame to which a plurality of rollers are attached allowing for the placement and rotation of a continuously formed, or connected, stretch belt. The plurality of rollers may be fixedly attached at the ends to the frame in a manner that is perpendicular to the direction of travel of the stretch belt. The plurality of rollers disposed perpendicularly to the direction of travel of the media may be provided on each end with structures allowing for smooth and unimpeded turning of the rollers. The frame may include an enclosure allowing for the application of an adhesive force to aid in stabilizing individual substrates of the output image receiving media on the belt. This enclosure may create, for example, a plenum beneath the rollers allowing for the application of a vacuum to be pulled through, or between, the plurality of rollers, such as, for example, through perforations in the belt designed to allow for a vacuum to be drawn against the back of individual output image receiving media substrates. At least one drive belt roller may be disposed in a perpendicular manner to the direction of travel of the media and may be fixedly attached to a motor providing for rotation so as to transport the media in a previously designated direction of travel.

These and other features and advantages of the disclosed embodiments are described in, or apparent from, the following detailed description of embodiments.

BRIEF DESCRIPTION OF THE DRAWINGS

Various exemplary embodiments of disclosed system will be described, in detail, with reference to the following figures, wherein.

DETAILED DESCRIPTION OF EMBODIMENTS

The following description of various exemplary embodiments of systems and methods that may be associated with one or more image forming devices including a plurality of fusers, and/or one or more radius profiled media handling systems for transporting unfused media in a non-linear path, in the one or more image forming devices, may refer to and/or illustrate components of an electrographic or xerographic image forming device as one specific type an image forming device with which either or both of such systems and/or modules may be associated for the sake of clarity and ease of depiction and description. However, it should be appreciated that, in various exemplary embodiments, systems and methods including either or both of a plurality of fusers, and/or one or more radius profiled media handling systems for transporting image receiving media in an image forming device, in a non-linear path, as illustrated, for example, in the figures, with principles disclosed herein, as outlined and/or discussed below, can be equally applied to any known, or later-developed, image forming device within which one or more of such systems may be advantageously accommodated, or may be advantageously employed in other applications not precisely related to any image forming operations.

The capabilities incumbent in disclosed systems and methods have as one of several objectives increasing output quantity (throughput) of; and reducing overall costs associated with, image production by, for example, using a plurality of fusers, of limited, or lesser, capacity and cost, which are readily available, and/or by providing for non-linear transport of unfused media of an image forming device by, for example, optimizing energy usage within the image forming device, as specifically related to heating, for example, individual fusers, and/or providing a capability whereby the design and/or footprint of the image forming device may be compacted by optimizing image handling along non-linear paths.

Figure 1:
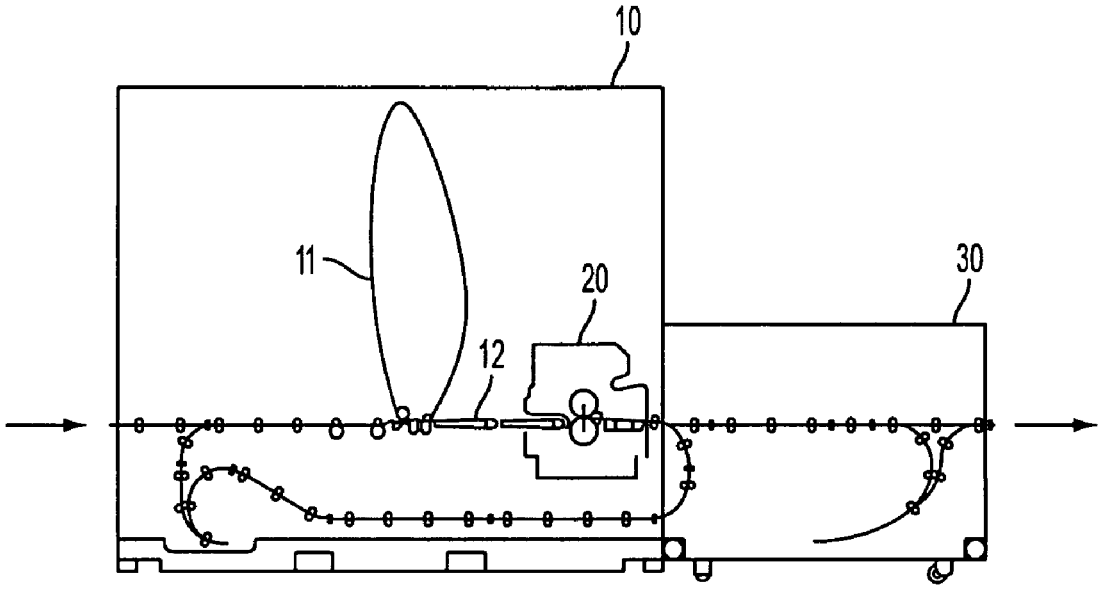
FIG. 1 RELATED ART
FIG. 1 illustrates a conventional image forming device configuration employing a single fuser in a fusing module associated with an image forming device marking module and a single linear path for transporting unfused media from the marking module to the fusing module.

FIG. 1 illustrates a conventional image forming device system 10 employing a single fuser in a fusing module associated with an image forming device marking module 11 and a single linear path 12 for transporting unfused media from the marking module to the fusing module 20. The system 10 includes a marking module 11 (represented by the depicted belt type photoreceptor device), a linear transport path 12, a single fuser fusing module 20 leading ultimately to some form of output device and/or unit 30.

It should be appreciated that the marking module 11, although substantially depicted as a marking module 11 which can reasonably be considered to be associated with an electrostatic and/or xerographic image forming device, as typified by some manner of photoreceptor transfer device, marking modules in related art devices and those discussed and described herein are not limited to such applications. In other words, marking modules that may be associated with other components according to this disclosure are envisioned to be capable of being incorporated in any type of image forming device.

It should also be appreciated further that the output device 30 may be any type of output device, i.e., a sorter, binder, inverter, or like output image receiving media handling device. The fusing module 20 is disposed in a linear path with the marking module 11 via a linear transport path 12 for receiving output image receiving media to be transported at least between the marking module 11 and the fusing module 20.

The overall throughput capacity of the fusing module 20 is generally lower than the overall throughput capacity of the marking module 11. This is particularly true in, for example, duplex operations due to the time delay required in inverting the output image receiving media. As such, a throughput capacity of the system 10 is often limited by the throughput of the fusing module 20, particularly based on the presence of only a single fuser in the fusing module 20.

While this description will generally refer to internal pathways of an exemplary image forming device, it should be recognized that transport of image receiving media may also include external pathways, work areas and/or associated devices from, or to, which image receiving media, for example, may be transported before, during or after image forming operations in the image forming device or in a system of which a marking module of an image forming device is a component. This disclosure is intended to include units designed to transport image receiving media between a plurality of image forming devices, and/or additional devices used in the production of output image receiving media, such as, for example, among a plurality of fusing modules and/or along one or more radius profiled media handling transport paths.

Disclosed systems and methods may include one or more sensors placed in such a manner to detect presence of image receiving media product in one or more designated transport paths, fusing modules or radius profiled media handling transport paths in the system. It should be appreciated that the detection of image receiving media product in one or more designated transport paths is well known in the art and will not be further discussed.

Disclosed systems and methods may include one or more sensors placed in such a manner to detect presence of any simplex and/or duplex image. It should be appreciated that the detection of simplex and/or duplex images is well known in the art and will not be further discussed.

Figure 2:
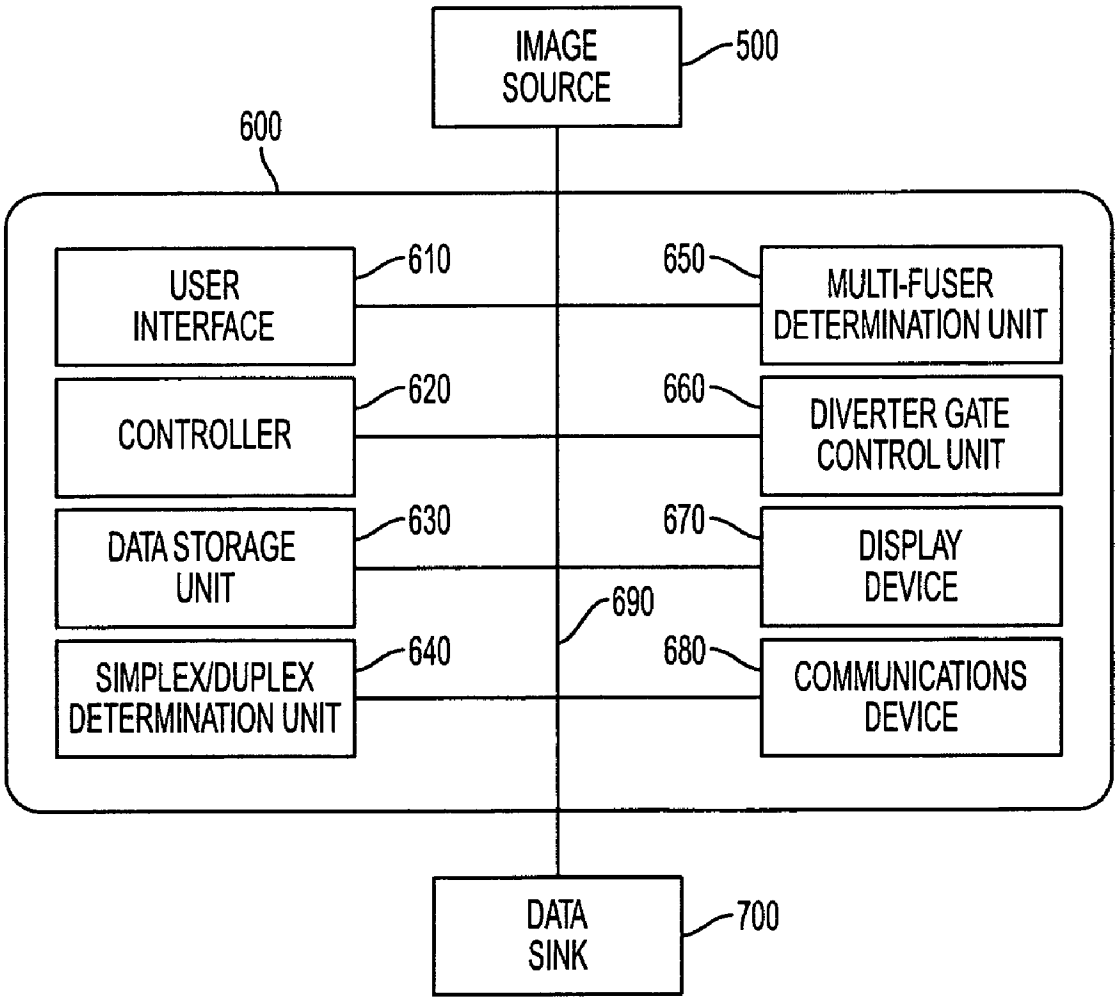
FIG. 2 schematically illustrates a block diagram of an exemplary embodiment of a system for operating a configuration of an image forming device employing a plurality of fusers in a fusing module.

FIG. 2 schematically illustrates a block diagram of an exemplary embodiment of a system for operating a configuration of an image forming device 600 employing a plurality of fusers. As shown in FIG. 2, the system 600 may include a image source 500, a user interface 610, a controller 620, a data storage unit 630, a simplex/duplex determination unit 640, a multi-fuser determination unit 650, a diverter gate control unit 660, a display device 670, a communications device 680, and a data sink 700, all connected via a data/control bus 690. Such data/control bus 690 may include one or more wired or wireless connections to any of the involved devices, units and/or modules.

The system 600 may include a user interface 610 to provide a capacity for a user to enter, or be able to view, any instruction, to include an ability to designate one or more fusers among a plurality of fusers in an image forming device. Separately, instructions may be viewable on a dedicated display device 670 associated with the image forming device. It should be appreciated that the user interface 610 is contemplated to allow for presentation and receipt of user messages in a full spectrum of audio and/or visual formats. The user interface 610 may be in communication with the various system components by the data/control bus 690, or otherwise by any means by which data communication between the user interface 610 and the other components of the system 600 may be implemented.

The system 600 may include a controller 620 to monitor and control various operations of the system 600 to effect and/or facilitate execution of any manner of functioning of individual components within the system to include, but not be limited to, multiple fuser coordination among a plurality of fusers with which the system may be associated. The controller 620 may be in communication with the various system components by the data/control bus 690, or otherwise by any means by which data communication between the controller 620 and the other components of the configuration of the system 600 may be implemented.

The controller 620 may receive input from the simplex/duplex determination unit 640 and the user interface 610, and provide output to the multi-fuser determination unit 650, and the diverter control unit 660. Once it is determined, either by means of the user interface 610, the simplex/duplex determination unit 640 or other means associated with the system 600 that a plurality of fusers may be required to meet or exceed the throughput of a marking module, in an image forming device with which the system 600 is associated, the controller 620 may designate multiple fuser operations via the multi-fuser determination unit 650 and provide appropriate input to the diverter gate control unit 660 and/or control various other components, as required.

The system 600 may include one or more multi-fuser determination units 650 that may be used to compare various inputs from a variety of system components and to select appropriate methods of operation based on those determinations, as described above. A multi-fuser determination unit 650 may receive input from, and may provide input to, the controller 620. If the controller 620, based on various system inputs indicates that the media is to be directed to a designated one of a plurality of fusers, the multi-fuser determination unit 65 or the controller 620 may send input to energize or optimize the designated fuser. Separately, the diverter gate control unit 660 may provide input to one or more diverter gates in an output image receiving media handling path to position one or more diverter gates so that the image receiving media, upon exiting the marking module, may be transported to the designated fuser.

The various determination units 640 and 650 may be in communication with the various system components via the data/control bus 690, or otherwise by any means by which data communication between the determination units 640 and 650 and the other components of the system 600 may be implemented.

The system 600 may include a communications device 680 that is usable to communicate, receiving or transmitting, to local or remote users, additional image forming devices and/or others systems. For example, the communications device 680 may receive user input from a remotely-located user to the system 600. A user may be remotely located from the image forming device with which the system 600 is associated, and user instructions and user interface menu prompts, warnings and messages, may be sent via the communications device 680 to communicate the status of the system 600 to the remotely-located user via a compatible data receiving device (not shown). It is contemplated that a local and remote user shall have the same interaction with the system 600 of the image forming device, independent of location. Such communications may be effected, via the communications device 680, with any of the various components of the system 600 or otherwise associated with the image forming device. It is also contemplated that the system 600 may be employed, for example, in a networked system of a plurality of image forming devices that employs additional devices such as binders, sorters, distribution devices, scanners, and the like.

It should be appreciated that communications may be undertaken with various components of the system 600, or otherwise in the image forming device with which the system 600 is associated, by either wired or wireless data exchange systems, as well as any combination thereof. Further, it should be appreciated that communications, as described above, are intended to include web-based network and local area network communications, in addition to remote, and/or local, operation from any manner of information or data exchange device such as, for example, personal computers and/or various other communication devices such as Personal Data Assistants (PDAs), smart phones, and the like. The communications device 680 may be in communication with the various system components via the data/control bus 690.

The system 600 may include a data storage unit 630 to allow for retention of various operating parameters. Such operating parameters may include, but are not limited to, user instructions received by any means, including via the user interface 610, and the status of the various determination units 640 and 650. It is contemplated that the operating parameters may be stored within the data storage unit 630 until such time as the parameters are changed based on the systems and methods described relating to the system 600. The data storage unit 630 may be in communication with the various system components via the data/control bus 690, or otherwise by any means by which data communication between the data storage unit 630 and the other components of the system 600 or the image forming device may be implemented.

In various exemplary embodiments, an image forming device may include an initiating device that allows a user to initiate an image forming device functions or an image forming operation in the image forming device. Input provided, for example, via the user interface 610, may initialize the functioning of the image forming device with which the system 600 is associated and activate, for example, the controller 620 of the system 600. The user interface 61 0 may be one of several available methods or devices for initiating the image forming device. Once the image forming device is initialized, the various components of the system 600 may determine a requirement for, for example, single or multiple fuser operation of the image forming device.

It should be appreciated that the various determination units 640 and 650 described above, may use some sensed input from various sensors of the image forming device. These sensors may include one or more designated transport sensors, or one or more multi-purpose transport sensors, for detecting the presence of media on a designated transport device of an image forming device in order that a user may be alerted to a potential for disruption of the media.

It should be further appreciated that other options may be provided to a user via the user interface 61 0 if the system 600 determines, for a given operating mode of the image forming device, that a specific combination of the determination units 640 and 650, the transport devices and/or the first plurality of sensor inputs should automatically inhibit and/or cancel, or request information regarding manually inhibiting and/or canceling a particular image forming operation within the image forming device. Any range of such options is contemplated such that, for example, when a specific set of circumstances dictates that when an image forming operation should be aborted, such abort may supercede, or be guided by the systems and methods of this embodiment.

It should be appreciated that, while shown in FIG. 2 as a single composite unit, the system 600 may be either a unit and/or capability internal to an image forming device, internal to any component of an image forming device, or may be separately presented as a stand-alone system, unit or device such as, for example, a separate server connected to an image forming device. Further, it should be appreciated that each of the individual elements depicted as part of the system 600 may be implemented as part of a single composite unit or as individual separate devices, alone or in any combination of devices or functionalities. For example, the determination units 640 and 650 and controller 620 may be integral to a single composite unit communicating with other components of the system 600. As noted above, it should be appreciated that, while depicted as separate units, the determination units 640 and 650, controller 620, and various other components may be separately attachable to the system as composite multi-function input/output components such as, for example, multi-function devices that include determination unit/controller/sensor capability all within a single unit with a separate user interface as part of the single composite unit.

It should be appreciated that given the required inputs, software algorithms, hardware circuits, and/or any combination of software and hardware control elements, may be used to implement the individual devices and/or units in the exemplary system 600.

It should be further appreciated that any of the data storage devices depicted in FIG. 2, or otherwise as described above, can be implemented using any appropriate combination of alterable, volatile or non-volatile memory, or non-alterable, or fixed, memory. The alterable memory, whether volatile or non-volatile can be implemented using any one or more of static or dynamic RAM, a floppy disk and associated disk drive, a writeable or re-writeable optical disk and associated disk drive, a hard drive/memory, and/or any other like memory and/or device. Similarly, the non-alterable of fixed memory can be implemented using any one or more of ROM, PROM, EPROM, EEPROM and optical ROM disk, such as a CD-ROM or DVD-ROM disk and compatible disk drive or any other like memory storage medium and/or device.

Figure 3:
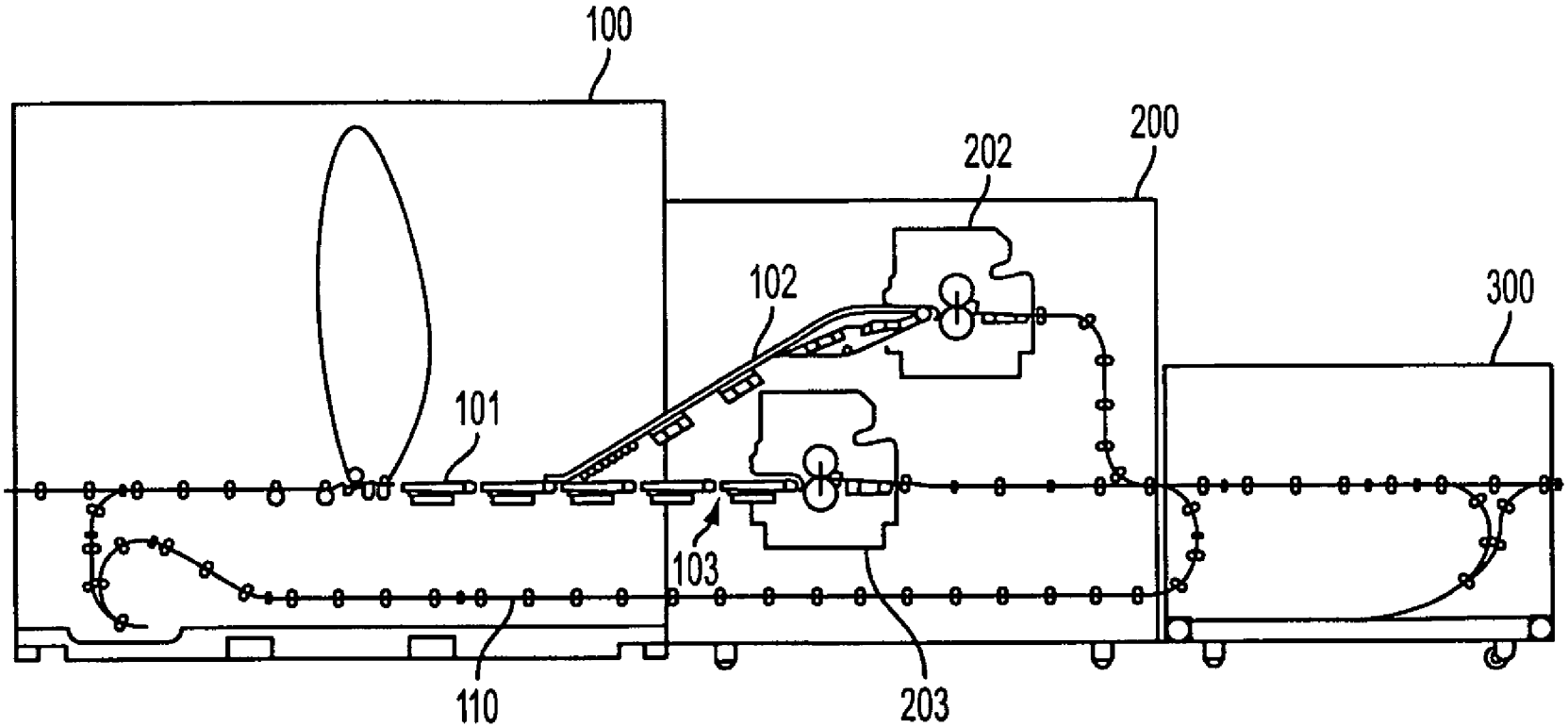
FIG. 3 illustrates an exemplary embodiment of a configuration of an image forming device consisting of a marking module, multi-fuser fusing module and output module.

FIG. 3 is an exemplary embodiment of an image forming device for providing a plurality of fusers 202, 203 in a fusing module 200 disposed between a marking module 100 and an output module 300. It should be appreciated that, while FIG. 3 illustrates two fusers 202, 203, it is anticipated that any number of fusers may comprise a plurality of fuser to be incorporated in one or more fusing modules in the image forming device.

Figure 4:
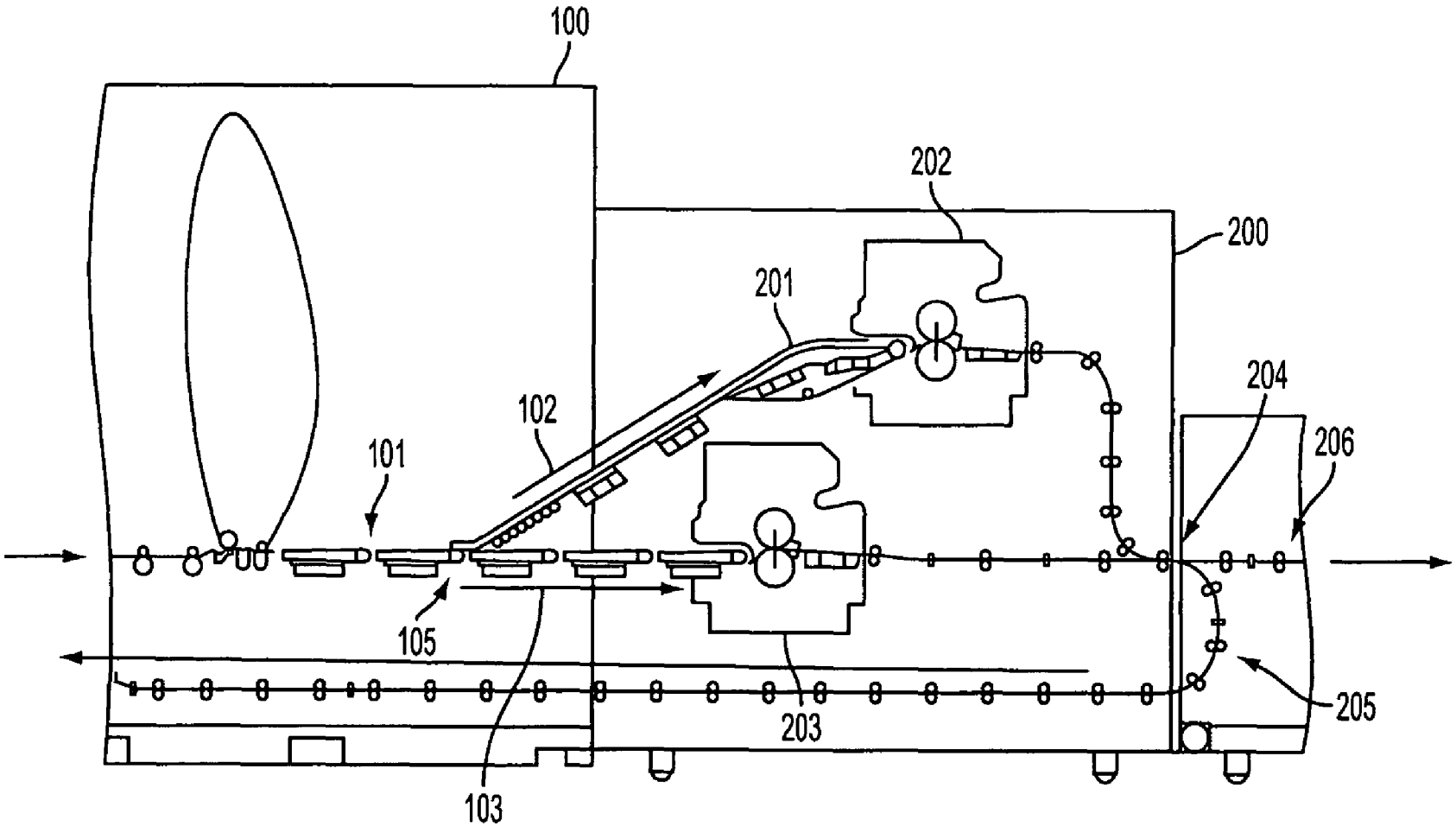
FIGS. 4 illustrates in greater detail, the exemplary embodiment of the configuration of the image forming device of FIG. 3, employing a plurality of fusers in the fusing module.

FIG. 4 illustrates, in greater detail, an exemplary embodiment of a configuration of a fusing module 200 the image forming device of FIG. 3 employing a plurality of fusers in the fusing module 200. A marking module 100 may apply an image forming substance, such as, for example, toner, to an output image receiving medium, representing a copy of text and/or graphics, and may output the image receiving medium, in a manner so as to not disturb the toner image formed on the output image receiving medium. The output image receiving medium may be transported from the marking module 100 along a transport device 101 to a diverter gate 105.

Upon determination that multi-fuser operation is should be undertakens, the diverter gate 105 may divert the unfused media between transport paths 102 and 103. It should be appreciated that determination of multi-fuser operation may be made automatically by various sensors and controllers associated with the image forming device, or may be determined based on user input via, for example, a user interface. It should also be appreciated that one fuser may be pre-designated for fusing a first side of an unfused media, and a second fuser may be pre-designated for fusing a second side of the unfused media in duplex operations. However, it should be appreciated that an individual fuser, among a plurality of fusers, may be interchangeable so as to be available to accomplish any fusing function with respect to individual substrates of unfused media such as, for example, fusing either a first side, a second side or both sides of the unfused media in duplex operations.

It should be appreciated that while the exemplary embodiment illustrated by FIG. 3 shows a diverter gate 105 being disposed within the marking module 100, it may also be disposed remotely from the marking module 100, such as within the fusing module 200, among multiple fusing modules, if present, or with respect to individual fusers 202, 203, or anywhere along the transport path that begins at the transport device 101 of the marking module 100.

Individual fusers 202, 203 may have a throughput capacity less than, or equal to, the throughput capacity of the image forming device. The total combined throughput capacity of the plurality of fusers may be equal to, or greater than, the throughput of the marking module 100.

It should be noted that FIG. 4 also depicts an exemplary radius profiled media handling device 201 according to this disclosure disposed on the inlet side of one of the plurality of fusers 202.

Such a radius profiled media handling system 201 may facilitate non-linear transport of unfused media in a manner so as to not disturb an unfused toner formed image on an unfused media.

Unfused media, upon exit from a first side fuser in duplex operation, may be transported to an inverter 110 (see FIG. 3) where an output image receiving medium is inverted and transported through the marking module 100 a second time. FIG. 3 illustrates inverter 110 disposed within the marking module 100, however, it should be anticipated that an inverter may be disposed remotely to the marking module 100 anywhere along the transport path after the marking module 100.

The output image receiving media exits the inverter 110 and is transported through the marking module 100 a second time where, on a second side of the output image receiving medium, an unfused toner image is formed.

The unfused media, with the unfused toner image, may be transported from the marking module 100 to potentially a second fuser where the toner image is fused to the second side of the output image receiving medium. The output image receiving medium may then be transported to an output module 300.

It should be understood that while FIG. 3 illustrates an output 300 module that is a separate module from the fusing module 200 and the marking module 100, the various modules of the image forming device may be combined into a single module, separate modules, or some combination thereof.

Output module 300 is anticipated to be any type of process associated with the handling and/or distribution of fused output image receiving media of an image forming device.

Figure 5:
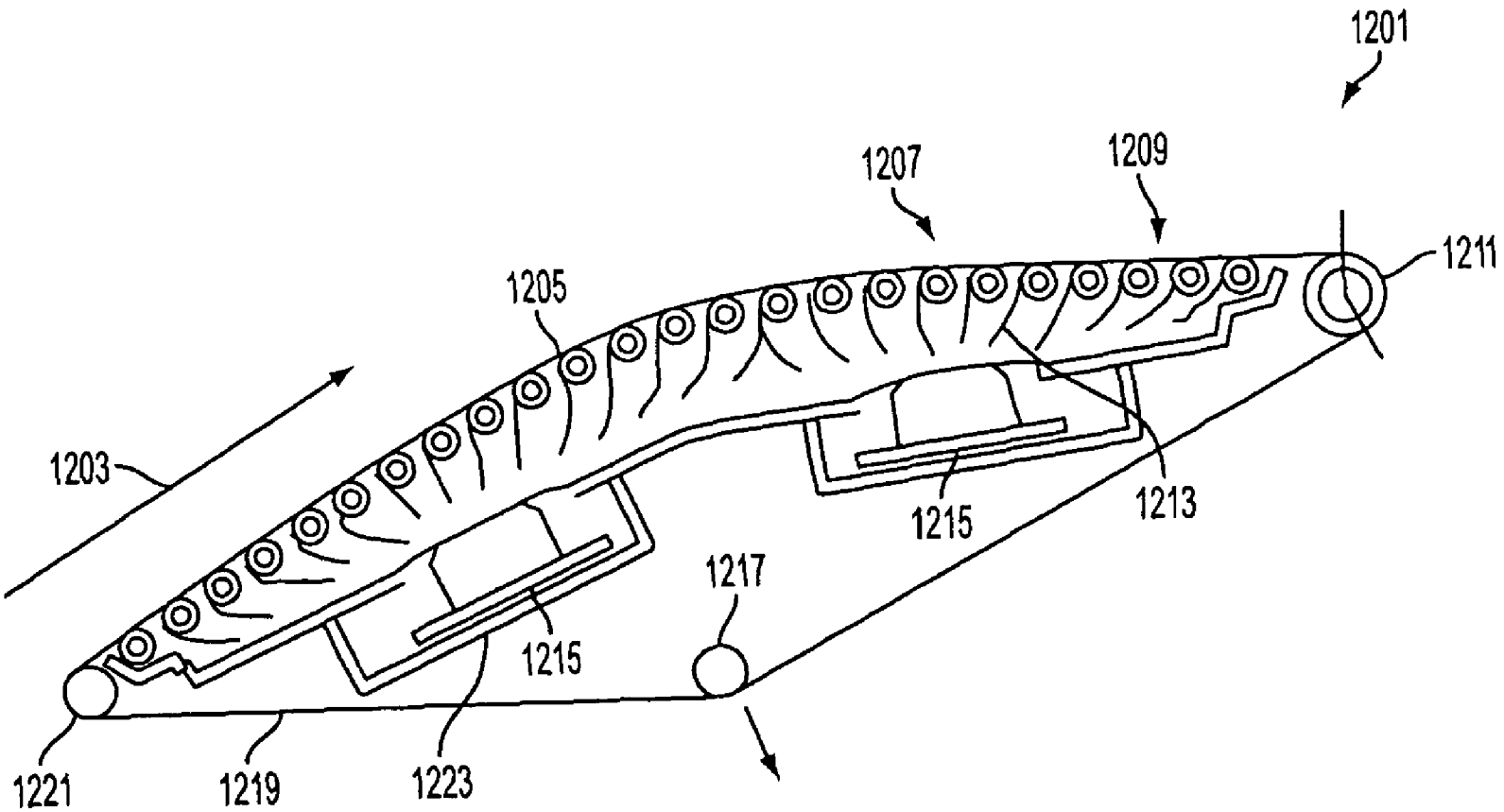
FIG. 5 illustrates an exemplary embodiment of a radius profiled media handling system for an image forming device.
Figure 6:
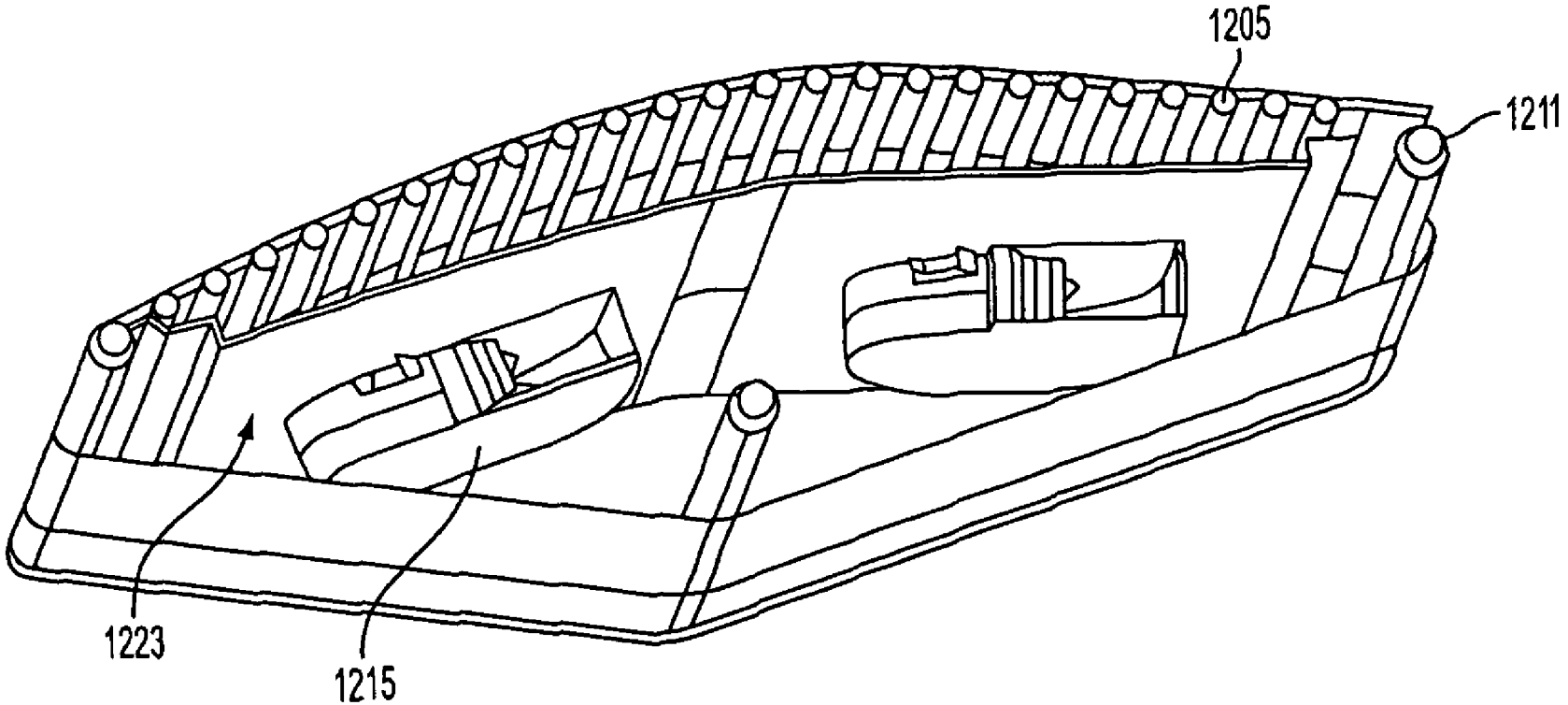
FIG. 6 illustrates a first perspective view of the exemplary embodiment of the radius profiled media handling system shown in FIG. 5.
Figure 7:
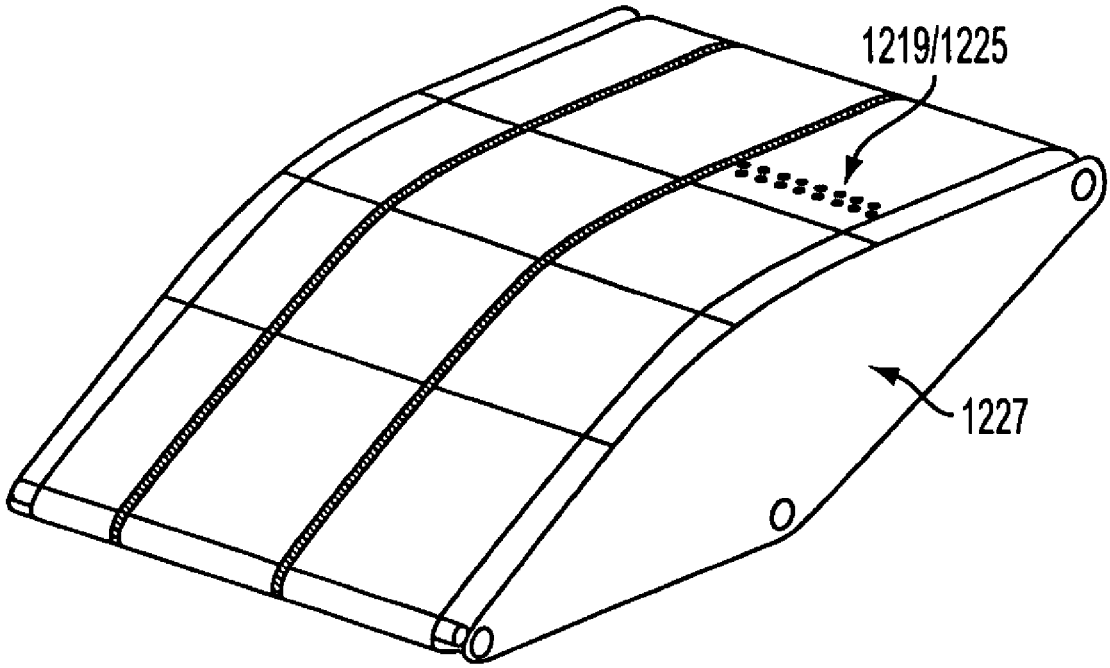
FIG. 7 illustrates a second perspective view of the exemplary embodiment of the radius profiled media handling system shown in FIG. 5.

FIGS. 5-7 illustrate multiple detailed aspect views of an exemplary embodiment of a radius profiled media handling device 1201 that may facilitate the transport of unfused media in a non-linear path without disrupting an unfused toner image formed on the unfused media.

The radius profiled media handling device 1201 may include a frame 1227 (see FIG. 7) providing structural support for the components of the device 1201. It should be appreciated that the frame 1227 may be manufactured from any type material that provides the structural support required for such a device 1201, i.e., aluminum, steel, plastic, or the like.

The device 1201 may include a plurality of rollers 1205 attached to the frame 1227 by hearings in such a fashion to provide for the smooth rotation of the plurality of rollers 1205. The plurality of rollers 1205 may be manufactured from any material that is compatible with a transport belt 1219, and allows for the smooth transport of output image receiving media particularly such output image receiving media as may have image forming material deposited on the output image receiving media that has not been fixed to the output image receiving media. It should be appreciated that the manufacture of rollers compatible with material of associated tension belts is well known in the art and will not be further discussed.

The device 1201 may include at least one drive roller 1211 that provides for rotation of the transport belt 1219 along the perimeter or outer surface of the device 1201. Additionally, one or more transport belt tension rollers 1217 may be movably mounted within the device 1201 to be adjustable in such a manner as to automatically or manually allow for increasing decreasing the tension of the transport belt 1219. It should be understood that the transport belt tension roller 1217 may be adjusted automatically based on predetermined conditions associated with type of media, or may be adjusted automatically or manually based on user input.

The frame 1227 may be an integral structure providing at least one substantially closed internal cavity that may be employed as an air plenum 1223. Such as air plenum 1223 may allow for the movement of air through the transport belt 1219 in a manner that provides a vacuum pressure between the transport belt 1219 and substrates of output image receiving media 1207 being transported by the transport belt 1219 of the device 1201. The vacuum pressure may be provided by at least one blower 1215 located locally or remotely from the device 1201. It should be understood that the vacuum pressure may be provided by any type device existing in the image forming device, or an system external to the image forming device useable to draw such a vacuum within the air plenum 1223.

FIG. 5 illustrates two blowers 1215 fixedly attached to the plenum 1223, however, it should be understood that at least one blower may be provided, and that the at least one blower may be provided externally to the plenum 1223 and the device 1201.

The device 1201 may include a plurality of plenum guides 1213 disposed internal to the air plenum 1223 allowing for a more even distribution of air flow between the rollers 1205.

The transport belt 1219 may be provided with a plurality of holes 1225, as illustrated in FIG. 7, that allow for the movement of air through the transport belt 1219, the rollers 1205, and into the air plenum 1223. It should be understood that FIG. 6 illustrates only a portion of the plurality of holes 1225, for clarity, and that the plurality of holes 1225 may cover in some pattern a continuous portion of the surface of the transport belt 1219.

The above detailed description of exemplary embodiments of methods and system for providing a multi-fuser configuration and radius profiled media transport in an image forming device is meant to be illustrative, and in no way limiting. The above detailed description of methods and system is not intended to be exhaustive or to limit this disclosure to any precise embodiments or feature disclosed. Modifications and variations are possible in light of the above teaching. The above embodiments were chosen to clearly explain the principles of operation of the systems and methods according to the disclosure and their practical application to enable others skilled in the art to utilize various embodiments, potentially with various modifications, suited to a particular use contemplated. Also, various modifications may be subsequently made by those skilled in the art, and are also intended to be encompassed by the following claims.

What is claimed is:

1. A system for image receiving media transport in an image forming device, comprising:

a marking module for depositing an image forming substance on individual substrates of image receiving media;

a fusing module, with at least two fusers, each fuser is configured for fixing the image forming substance on the individual substrates by applying at least one of heat or pressure; and a first transport path for transporting the individual substrates of image receiving media in the image forming device, the first transport path comprising:

at least one linear transport path section, with at least one of the at least two fusers; and at least one non-linear transport path unit, with at least a second of the at least two fusers, across which the individual substrates are transported in a non-linear manner, wherein the at least two fusers are configured to operate in parallel with each other, wherein a throughput capacity for the fusing module with regard to processing the individual substrates is an aggregate of combined throughput capacities of the plurality of fusers, the throughput capacity of the fusing module exceeding the throughput capacity of any other module in the image forming device.

2. The system of claim 1, the at least one non-linear transport path unit comprising:

a frame structure that is configured to enclose at least one internal hollow cavity, the frame structure comprising:

a transport surface across which the individual substrates are transported, the transport surface being non-linear; and a plurality of side surfaces with substantially similar profiles that face each other and are orthogonal to the transport surface, wherein at least a portion of the transport surface comprises one surface of the at least one internal hollow cavity.

3. The system of claim 2, wherein at least the portion of the transport surface comprising the one surface of the at least one internal hollow cavity is perforated with a first plurality of holes.

4. The system of claim 3, wherein the at least one internal hollow cavity comprises an air plenum chamber.

5. The system of claim 4, further comprising a vacuum device in communication with the air plenum chamber to provide a vacuum pressure through at least some of the first plurality of holes.

6. The system of claim 5, further comprising a transport belt fitted over, and in close contact with, the transport surface of the frame structure, the transport belt being movable in a transport direction across the transport surface of the frame structure.

7. The system of claim 6, wherein the ends of the transport belt are mated together to form a continuous belt.

8. The system of claim 6, wherein the transport belt is perforated with a second plurality of holes in such a pattern that, as the transport belt is moved in the transport direction across the transport surface of the frame structure, the second plurality of holes cooperates with the first plurality of holes to translate the vacuum pressure through the transport belt.

9. The system of claim 8, further comprising a plurality of rollers attached at each end to two of the plurality of side surfaces of the frame, the axes of the rollers being substantially perpendicular to the transport direction, the rollers supporting movement of the transport belt in the transport direction.

10. The system of claim 9, wherein the air plenum chamber further comprises a plurality of plenum guides that direct movement of air between one or more of the plurality of rollers.

11. The system of claim 9, wherein at least one of the plurality of rollers is at least one of (1) a drive roller for driving the transport belt in the transport direction or (2) a tension roller that is positioned to exert pressure to maintain the close contact between the transport belt and the transport surface of the frame structure.

12. The system of claim 9, wherein at least a portion of the first transport path is positioned between the marking module and the fusing module, the at least one non-linear transport path unit is positioned in the portion of the first transport path positioned between the marking module and the fusing module, the non-linear transport surface is radius profiled, the image forming substance is image forming toner, and the plurality of rollers are arranged to provide non-linear transport of the individual substrates with the image forming toner applied to the substrates to form images on the substrates, without disturbing the images formed by the image forming toner prior to being fused.

13. An image forming device including the system of claim 1.

14. A xerographic image forming device including the system of claim 1.

15. The system of claim 1, further comprising at least a second transport path, wherein the first transport path transports some of the individual substrates between the marking module and a first one of the plurality of fusers, and the at least the second transport path transports others of the individual substrates between the marking module and at least a second one of the plurality of fusers.

16. The system of claim 15, wherein the at least the second transport path transports the others of the individual substrates between the marking module and the at least the second one of the plurality of fusers in a linear path.

17. The system of claim 15, wherein the at least the second transport path transports the others of the individual substrates between the marking module and the at least the second one of the plurality of fusers in a non-linear path.

18. The system of claim 15, further comprising a diverter gate for directing the some of the individual substrates and the others of the individual substrates respectively along the first transport path and the at least the second transport path.

19. The system of claim 18, further comprising a diverter gate control unit for controlling operation of the diverter gate.

20. The system of claim 19, wherein the diverter gate control unit automatically controls the diverter gate based on operating parameters of the image forming device, 21. The system of claim 19, further comprising one or more sensors associated with at least one of the transport paths or at least one of the fusers among the plurality of fusers, wherein the diverter gate control unit automatically controls operation of the diverter gate based on an input from at least one of the one or more sensors.

22. The system of claim 19, wherein the diverter gate control unit controls operation of the diverter gate based on a received user input.

23. The system of claim 1, further comprising a selection unit for selecting operation of individual fusers among the plurality of fusers.

24. The system of claim 23, wherein the selection unit automatically selects operation of more than one individual fuser among the plurality of fusers based on operating parameters of the image forming device.

25. The system of claim 23, further comprising one or more sensors associated with at least one of the transport paths or at least one of the fusers among the plurality of fusers, wherein the selection unit automatically selects operation of more than one individual fuser among the plurality of fusers based on an input from at least one of the one or more sensors.

26. The system of claim 23, wherein the selection unit selects operation of more than one individual fuser among the plurality of fusers based on a received user input.

27. The system of claim 23, wherein the selection unit selects a single fuser among the plurality of fusers during simplex operation.

28. The system of claim 23, wherein the selection unit selects more than one fuser among the plurality of fusers during duplex operation.

29. An image forming device including the system of claim 1.

30. A xerographic image forming device including the system of claim 1.

* * * * *